US005910749A

United States Patent [19]

Kimura

[11] Patent Number: 5,910,749

[45] Date of Patent: Jun. 8, 1999

[54] CURRENT REFERENCE CIRCUIT WITH SUBSTANTIALLY NO TEMPERATURE DEPENDENCE

[75] Inventor: Katsuji Kimura, Tokyo, Japan

[73] Assignee: NEC Corporation, Tokyo, Japan

[21] Appl. No.: 08/740,508

[22] Filed: Oct. 30, 1996

[30] Foreign Application Priority Data

Oct. 31, 1995 [JP] Japan ..... 7-283843

[51] Int. Cl.[6] ..... G05F 1/10

[52] U.S. Cl. ..... 327/541; 327/540; 327/543; 327/545; 327/539; 327/315

[58] Field of Search ..... 327/538, 540, 327/541, 543, 545, 546, 539; 323/315, 316; 325/513

[56] References Cited

U.S. PATENT DOCUMENTS

| | | | |
|---|---|---|---|
| 3,924,143 | 12/1975 | Cunningham et al. | 323/315 |
| 4,390,829 | 6/1983 | Jarrett | 323/315 |
| 4,450,366 | 5/1984 | Malhi et al. | 323/315 |
| 4,603,290 | 7/1986 | Shinomiya | 323/315 |
| 4,945,260 | 7/1990 | Naghshineh et al. | 327/539 |
| 5,027,014 | 6/1991 | Bass et al. | 323/315 |
| 5,357,149 | 10/1994 | Kimura . | |
| 5,391,979 | 2/1995 | Kajimoto et al. | 327/543 |
| 5,438,296 | 8/1995 | Kimura . | |
| 5,481,224 | 1/1996 | Kimura . | |
| 5,488,329 | 1/1996 | Ridgers | 327/539 |
| 5,500,623 | 3/1996 | Kimura . | |
| 5,512,855 | 4/1996 | Kimura . | |
| 5,581,211 | 12/1996 | Kimura . | |
| 5,607,466 | 3/1997 | Dreps et al. | 327/538 |
| 5,631,600 | 5/1997 | Akioka et al. | 327/543 |
| 5,701,097 | 12/1997 | Fisher et al. | 327/538 |

OTHER PUBLICATIONS

H. Hatada et al., "Reference Current Generator for 3.3V System", *Proceedings of the 1994 IEICE Spring Conference*, No. C–663, p. 231.

*Primary Examiner*—Terry D. Cunningham
*Attorney, Agent, or Firm*—Sughrue, Mion, Zinn, Macpeak & Seas, PLLC

[57] ABSTRACT

A bipolar or MOS current reference circuit is provided, which generates a reference current having no temperature dependence and which is able to be operated by a single battery having a supply voltage of approximately 1 V. This circuit includes a first transistor having an emitter or source and a base or gate connected through a resistor, a first current mirror subcircuit generating a first mirror current of an input current flowing through the resistor, and a second current mirror subcircuit generating a second current of the input current flowing through the resistor. The first mirror current has a negative temperature coefficient. The second mirror current has a positive temperature coefficient. The first and second mirror currents are added to generate a sum current having no temperature dependence, which is derived as a reference current. The sum current is supplied to the first transistor to thereby drive the first transistor. The first current mirror subcircuit may be a simple current mirror subcircuit. The second current mirror subcircuit may be a Widlar or Nagata current mirror subcircuit.

18 Claims, 5 Drawing Sheets

CURRENT REFERENCE CIRCUIT WITH SUBSTANTIALLY NO TEMPERATURE DEPENDENCE

BACKGROUND OF THE INVENTION

1. Field of the Invention

The present invention relates to a current reference circuit and more particularly, to a current reference circuit capable of generating a reference current with substantially no temperature dependence, which is able to be operated at a supply voltage of approximately 1 V.

2. Description of the Prior Art

Conventionally, a current reference circuit is used for generating a reference current having a constant current value and no temperature dependence. An example of conventional current reference circuits is shown in FIG. 1, which was disclosed in Proceedings of the 1994 IEICE spring conference, No. C-663.

In FIG. 1, three diodes D101, D102, and D103 are cascode-connected and driven by a constant current $I_0$ flowing therethrough. A base of an npn bipolar transistor Q117 is connected to an anode of the diode D101. A cathode of the diode D103 is connected to the ground. An emitter of the transistor Q117 is connected to one end of a resistor R105. A collector of the transistor Q117 is applied with a supply voltage $V_{DD}$.

An npn bipolar transistor Q114 has a base and a collector coupled together. An npn-bipolar transistor Q115 has a base connected to the base of the transistor Q114. Emitters of the transistors Q114 and Q115 are connected to the ground. These two transistors Q114 and Q115 constitute a simple current mirror subcircuit.

An npn bipolar transistor Q116 has a base connected to the bases of the transistors Q114 and Q115, and a collector connected to a collector of the transistor Q115. The transistor Q116 has an emitter connected to one end of an emitter resistor R106. The other end of the resistor R106 is connected to the ground. Thus, the emitter of the transistor Q116 is connected to the ground through the emitter resistor R106. These two transistors Q115 and Q116 and the emitter resistor R106 constitute a Widlar current mirror subcircuit.

When a current flowing through the resistor R105 is defined as $I_1$, a mirror current $I_2$ of the simple current mirror subcircuit with respect to the current $I_1$ flows at the collector of the transistor Q115, where $I_2=I_1$. Also, a mirror current $I_3$ of the Widlar current mirror subcircuit with respect to the current $I_1$ flows at the collector of the transistor Q116. $I_3$ is expressed as $I_3=(V_{BE114}-V_{BE116})/R106$, where $V_{BE114}$ is the base-to-emitter voltage of the transistor Q114, $V_{BE116}$ is the base-to-emitter voltage of the transistor Q116, and $R_{106}$ is the resistance of the emitter resistor R106.

A p-channel Metal-Oxide-Semiconductor Field-Effect Transistor (MOSFET) M111 has a gate and a drain coupled together to be connected to the coupled collectors of the bipolar transistors Q115 and Q116. The MOSFET M111 has a source applied with a supply voltage $V_{DD}$. A p-channel MOSFET M112 has a gate connected to the gate of the MOSFET M111 and a source applied with the supply voltage $V_{DD}$. The MOSFET M112 has a drain from which a reference current $I_{REF}$ with no temperature dependence is derived. These two MOSFETs M111 and M112 constitute a simple current mirror subcircuit.

A p-channel MOSFET M110 has a gate connected to the coupled gates of the MOSFETs M111 and M112. The MOSFET M110 has a source applied with the supply voltage $V_{DD}$ and a drain connected to the connection point of the base of the transistor Q117 and the anode of the diode D101. The two MOSFETs M111 and M110 constitute a simple current mirror subcircuit.

The collectors of the transistors Q115 and Q116 are coupled together and are connected to the coupled gate and drain of the MOSFET M111. Therefore, the sum of the mirror currents $I_2$ and $I_3$, i.e., $(I_2+I_3)$, flows through the MOSFET M111. Since the MOSFETs M111 and M112 constitute the simple current mirror subcircuit, a mirror current of the sum current $(I_2+I_3)$ flows through the MOSFET M112 as the reference current $I_{REF}$, which is derived from the drain of the MOSFET M112. Therefore, the reference current $I_{REF}$ is expressed as $I_{REF}=I_2+I_3$.

At the same time, since the MOSFETs M111 and M110 also constitute the simple current mirror subcircuit, another mirror current of the sum current $(I_2+I_3)$ flows through the MOSFET M110 and the cascode-connected diodes D101, D102, and D103 as the driving current $I_0$. The current $I_0$ flowing through the diodes D101, D102, and D103 generates a voltage drop, which generates a bias current for the transistor Q117. This bias current is supplied to the base of the transistor Q117 and makes it possible to form a current loop extending along the bipolar transistors Q117, Q114, Q115 and Q116, the resistor R105, and the MOSFETs M111 and M110.

One end of a capacitor C101 is connected to the connection point of the base of the transistor Q117, the drain of the MOSFET M110, and the anode of the diode D101. The other end of the capacitor C101 is connected to the ground. A voltage $V_{SS}$ is applied to the capacitor C101 to thereby store an electric charge therein. The stored charge in the capacitor C101 is discharged at the start of operation to thereby generate a start-up current, which is supplied to the base of the transistor Q117. Thus, the conventional current reference circuit of FIG. 1 starts to operate.

With the conventional current reference circuit in FIG. 1, supposing that the bias current generated by the diodes D101, D102, and D103 has no temperature dependence, the base-to-emitter voltage $V_{BE114}$ of the transistor Q114 has the same negative temperature coefficient of −2 mV/deg as that of the forward voltage drop of the diodes D101, D102, and D103. Therefore, the current $I_1$, which flows through the resistor R105, has a negative temperature coefficient on the supposition that the temperature coefficient of the resistor R105 is sufficiently small.

Since the current $I_1$ further flows through the diode-connected transistor Q114, the collector current (i.e., the mirror current) $I_2$ of the transistor Q115 also has a negative temperature coefficient.

On the other hand, the mirror current $I_3$ of the Widlar current mirror subcircuit has a positive temperature coefficient. In other words, the Widlar current mirror subcircuit generates the mirror current $I_3$ while it converts the negative temperature coefficient of the current $I_1$ into a positive one.

The output current $I_2$ of the simple current mirror subcircuit formed by the transistors Q114 and Q115 and the output current $I_3$ of the Widlar current mirror subcircuit formed by the transistors Q114 and Q116 and the resistor R106 are added to be supplied to the drain of the MOSFET M111. Therefore, by suitably weighting the respective mirror currents $I_2$ and $I_3$, in other words, by suitably setting the adding ratio of the currents $I_2$ and $I_3$, the temperature coefficient of the sum current $(I_2+I_3)$ supplied to the drain of the MOSFET M111 can be set as zero.

Thus, the temperature dependence of the reference current $I_{REF}(=I_2+I_3)$ can be removed.

With the conventional current reference circuit in FIG. 1, however, the three cascade-connected diodes D101, D102, and D103 are necessary to drive the simple current mirror subcircuit formed by the transistors Q114 and Q115 and the Widlar current mirror subcircuit formed by the transistors Q114 and Q116 and the resistor R106. Because each of the diodes D101, D102, and D103 requires a power supply voltage of at least 0.7 V, a necessary power supply voltage for the cascade-connected diodes D101, D102, and D103 is at least 2.1 V.

This means that the conventional current reference circuit of FIG. 1 is unable to be operated by a single battery having a supply voltage of 1.2 V, which disturbs the miniaturization of apparatuses using this current reference circuit.

SUMMARY OF THE INVENTION

Accordingly, an object of the present invention is to provide a current reference circuit for generating a reference current having no temperature dependence which is able to be operated by a single battery having a supply voltage of 1.2 V.

Another object of the present invention is to provide a current reference circuit for generating a reference current having no temperature dependence which is able to be operated at a power supply voltage of approximately 1 V.

The above objects together with others not specifically mentioned will become clear to those skilled in the art from the following description.

A current reference circuit according to the present invention includes a first transistor having an emitter or source and a base or gate, a resistor through which an input current flows, a first current mirror subcircuit for generating a first mirror current of the input current, a second current mirror subcircuit for generating a second current of the input current, and a driver subcircuit for driving the first and second current mirror subcircuits by the input current.

The emitter or source of the first transistor is connected to a first line kept at a first-level voltage. The base or gate of the first transistor is connected to a first end of the resistor. A second end of the resistor is connected to the first line. The first end of the resistor is further connected to a second line kept at a second-level voltage through the driver circuit.

The driver subcircuit has an input connected to the connection point of the resistor and the base or gate of the first transistor. The driving subcircuit has an output connected to the inputs of the first and second current mirror subcircuits, respectively.

The first mirror current has a negative temperature coefficient. The second mirror current has a positive temperature coefficient. The first and second mirror currents are added to generate a sum current having no temperature dependence.

The sum current is supplied to a collector or drain of the first transistor for driving the first transistor. The sum current is derived as a reference current.

With the current reference circuit according to the present invention, only the resistor and the driver subcircuit exist between the first and second lines. The driver subcircuit may be realized by using a single bipolar transistor or MOSFET located between the first and second lines.

If a specific supply voltage is applied across the first and second lines, the single bipolar transistor or MOSFET forming the driver subcircuit and the resistor are applied with the supply voltage.

Accordingly, the current reference circuit according to the invention is able to be operated at a supply voltage of approximately 1 V. This means that this current reference circuit can be operated by a single battery having a supply voltage of approximately 1.2 V.

The first transistor may be formed by a bipolar transistor or an MOSFET. Each of the first and second current mirror subcircuits may be formed by bipolar transistors or MOSFETs.

In a preferred embodiment of the circuit according to the invention, the first current mirror subcircuit is a simple current mirror subcircuit, and the second current mirror subcircuit is a Widlar current mirror subcircuit.

In another preferred embodiment of the circuit according to the invention, the first current mirror subcircuit is a simple current mirror subcircuit, and the second current mirror subcircuit is a Nagata current mirror subcircuit.

In still another preferred embodiment of the circuit according to the invention, the first current mirror subcircuit includes second and third transistors, and the second current mirror subcircuit includes fourth and fifth transistors. The third transistor has a capacity K1 times as much as that of the second transistor, where K1 is a positive constant. The fifth transistor has a capacity K2 times as much as that of the fourth transistor, where K2 is a positive constant. A weighting or adding ratio of the first and second mirror currents is determined by a ratio of K1 and K2 to remove the temperature dependence of the sum current.

The word "capacity" means an emitter area for a bipolar transistor and a gate-width to gate-length ratio (W/L) for an MOSFET.

In a further preferred embodiment of the circuit according to the invention, second and third transistors driven by a start-up current are further provided. The second transistor is connected to the resistor so that the input current flows through the second transistor. The third transistor supplies the input current to the inputs of the first and second current mirror subcircuits, thereby generating the first and second mirror currents, respectively.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
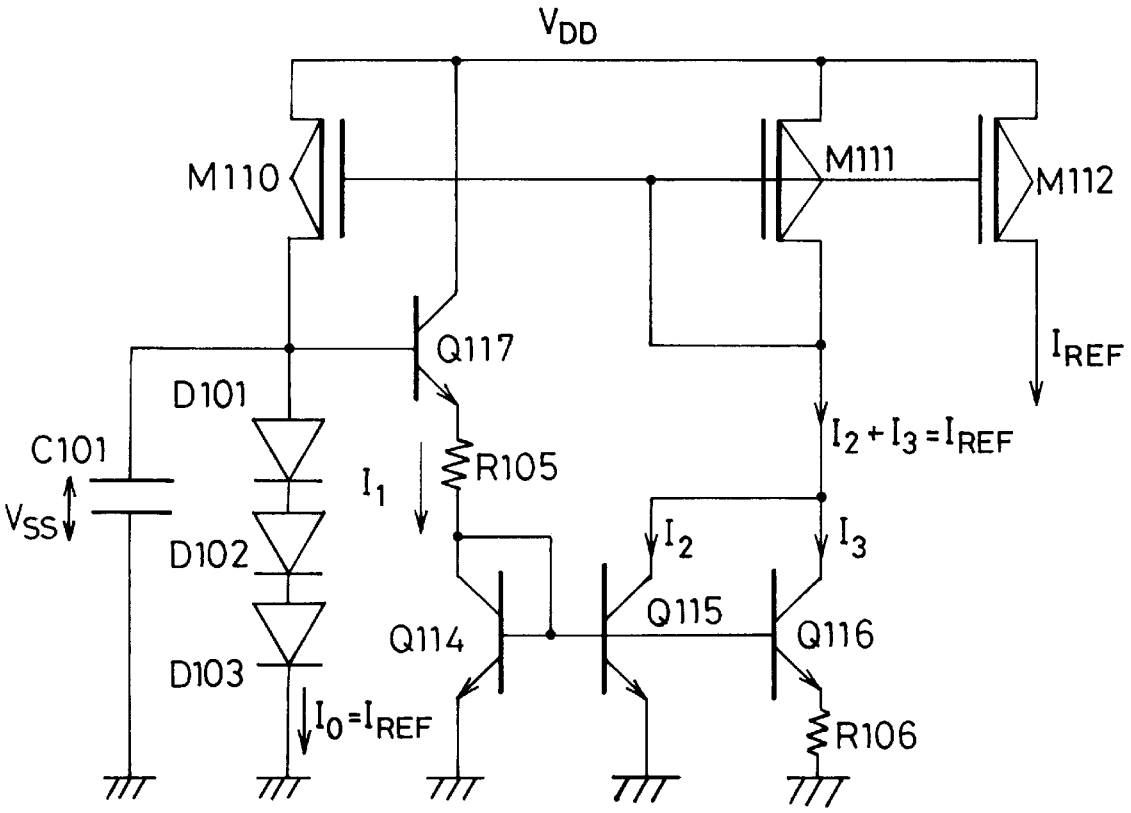
FIG.1 PRIOR ART
FIG. 1 is a circuit diagram of a conventional current reference circuit.

Preferred embodiments of the present invention will be described below by referring to the drawings attached.

FIRST EMBODIMENT

Figure 2:
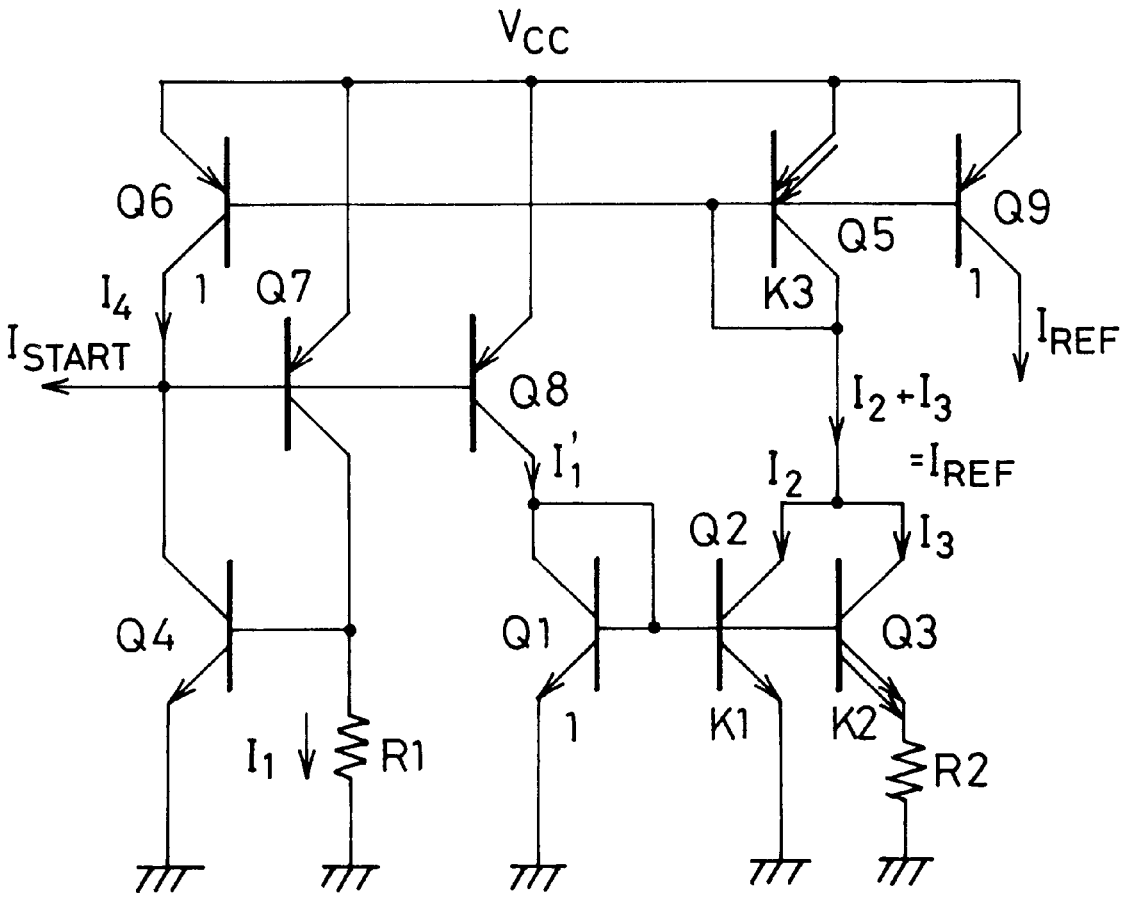
FIG. 2 is a circuit diagram of a bipolar current reference circuit according to a first embodiment of the present invention.

As shown in FIG. 2, a current reference circuit according to a first embodiment of the invention comprises an npn bipolar transistor Q4 having an emitter connected to the ground, and a base connected to one end of a base resistor R1. The other end of the resistor R1 is connected to the ground. The transistor Q4 is biased by a voltage drop generated by an input current $I_1$ flowing through the resistor R1.

Pnp bipolar transistors Q7 and Q8, which constitute a driver circuit for driving simple and Widlar current mirror subcircuits described later, have bases coupled together to be connected to a start-up circuit (not shown). The transistors Q7 and Q8 are respectively driven by a start-up current $I_{START}$ supplied by the start-up circuit through their bases at the start of operation. A collector of the transistor Q7 is connected to the connection point of the base of the transistor Q4 and the resistor R1. Emitters of the transistors Q7 and Q8 are connected to a power supply line (not shown) which is applied with a power supply voltage $V_{CC}$. The start-up circuit is further connected to a collector of the transistor Q4 to supply the start-up current $I_{START}$ thereto.

An npn bipolar transistor Q1 has an emitter connected to the ground. The transistor Q1 is diode-connected, i.e., a base and a collector of the transistor Q1 are coupled together. The coupled collector and base of the transistor Q1 are connected to the collector of the transistor Q8.

An npn bipolar transistor Q2 has an emitter connected to the ground and a base connected to the base of the transistor Q1. The transistor Q2 has an emitter area K1 times as that of the transistor Q1, where K1 is a positive constant. Here, since the emitter areas of the transistors Q2 and Q1 are the same, K1=1 is established.

The two transistors Q1 and Q2 constitute a simple current mirror subcircuit. When a collector current of the transistor Q8 is defined as $I_1'$, the current $I_1'$ serves as an input current of this simple current mirror subcircuit. Therefore, this subcircuit generates a mirror current $I_2$ of the current $I_1'$ at a collector of the transistor Q2.

Since the transistor Q2 is K1 times in emitter area as the transistor Q1, where K1=1, the two currents $I_1'$ and $I_2$ have a relationship of $I_2=K1 \cdot I_1'=I_1'$.

An npn bipolar transistor Q3 has an emitter connected to one end of an emitter resistor R2 and a base connected to the base of the transistor Q1. The other end of the resistor R2 is connected to the ground. A collector of the transistor Q3 is connected to the collector of the transistor Q2. The transistor Q3 has an emitter area K2 times as that of the transistor Q1, where K2 is a positive constant. Here K2 is greater than unity (i.e., K2>1) .

The two transistors Q1 and Q3 and the resistor R2 constitute a Widlar current mirror subcircuit. This subcircuit generates a mirror current $I_3$ of the input current $I_1'$ at the collector of the transistor Q3.

Since the transistor Q3 is K2 times in emitter area as the transistor Q1, the two currents $I_1'$ and $I_3$ have a relationship of $I_3=K2 \cdot I_1'$, where K2>1.

A pnp bipolar transistor Q5 is diode-connected; i.e., a base and a collector of the transistor Q5 are coupled together. The coupled base and the collector of the transistor Q5 are connected to the coupled collectors of the transistors Q2 and Q3.

A pnp bipolar transistor Q9 has a base connected to the base of the transistor Q5, and an emitter connected to the power supply line to be applied with the supply voltage $V_{CC}$. The transistor Q5 has an emitter area K3 times as much as that of the transistor Q9, where K3 is a positive constant. Here, K3 is greater than unity (i.e., K3>1).

A reference current $I_{REF}$ as an output of the current reference circuit according to the first embodiment is derived from a collector of the transistor Q9.

The two transistors Q5 and Q9 constitute a simple current mirror subcircuit. Because the collectors of the transistors Q2 and Q3 are connected in common to the collector of the transistors Q5, a collector current of the transistor Q5, which serves as an input current of this current mirror subcircuit, is expressed as the sum of the mirror currents $I_2$ and $I_3$, i.e., $(I_2+I_3)$. Since the transistor Q5 is K3 times in emitter area as the transistor Q9, the reference current $I_{REF}$ is expressed as $I_{REF}=(I_2+I_3)/K3$.

A pnp bipolar transistor Q6 has a base connected to the base of the transistor Q5, and an emitter connected to the power supply line to be applied with the supply voltage $V_{CC}$. The transistor Q6 has a collector connected to the collector of the transistor Q4. The transistor Q5 has an emitter area K3 times as much as that of the transistor Q6.

The two transistors Q5 and Q6 constitute a simple current mirror subcircuit. The input current of this simple current mirror subcircuit is expressed as $(I_2+I_3)$, and the transistor Q5 is K3 times in emitter area as the transistor Q6. Therefore, this current mirror subcircuit generates a mirror current $I_4$ which is equal to the reference current $I_{REF}$ at the collector of the transistor Q6. Thus, the transistor Q4 can be driven by the reference current $I_{REF}$, and a current loop extending along the bipolar transistors Q4, Q7, Q8, Q1, Q2, Q3, Q5 and Q6, and the resistors R1 and R2 is formed.

Next, the operation principle of the current reference circuit according to the first embodiment of FIG. 2 is explained below.

When a power switch (not shown) of this current reference circuit is turned on, the supply voltage $V_{CC}$ is applied across the supply voltage line and the ground and at the same time, the start-up current $I_{START}$ is supplied by the start-up circuit to the bases of the transistors Q7 and Q8. Thus, the transistors Q7 and Q8 are turned to the on-state, respectively.

Because the transistor Q7 has already been in the on-state, the current $I_1$ is able to flow through the base resistor R1 by the applied supply voltage $V_{CC}$. The current $I_1$ flowing through the resistor R1 generates a voltage drop, which biases the transistor Q4 through its base. Thus, the transistor Q4 is turned to the on-state.

Since the transistors Q7 and Q8 have the bases coupled together and are driven by the same start-up current $I_{START}$, the current $I_1'$ having the same current value as that of the current $I_1$ flows through the transistor Q8. This makes the transistor Q1 turn on, thereby starting the operation of the simple current mirror subcircuit formed by the transistors Q1 and Q2 and the Widlar current mirror subcircuit formed by the transistors Q1 and Q3 and the resistor R2.

These two current mirror subcircuits generate their mirror currents $I_2$ and $I_3$ of the input current $I_1'$ at the collectors of the transistors Q2 and Q3, respectively. These two mirror currents $I_2$ and $I_3$ are added to one another at the coupled collectors of the transistors Q2 and Q3. The sum current $(I_2+I_3)$ serves as the input current of the simple current mirror subcircuit formed by the transistors Q5 and Q9. This current mirror subcircuit generates the output reference current $I_{REF}$ as a mirror current of the input current $(I_2+I_3)$ at the collector of the transistor Q9, where $I_{RFF}=(I_2+I_3)/K3$.

At the same time, the simple current mirror subcircuit formed by the transistors Q5 and Q6 generates the mirror current $I_4$ of the input current $(I_2+I_3)$ at the collector of the transistor Q6, where $I_4=I_{REF}$. The current $I_4$ is supplied to the transistor Q4 which has been in the on-state. Thus, the above current loop is maintained during the operation of the current reference circuit according to the first embodiment.

Supposing that the mirror (or collector) current $I_4$ flowing through the transistor Q4 has no temperature dependence, the base-to-emitter voltage of the transistor Q4 has a negative temperature coefficient of −2 mV/deg. Since the transistor Q4 and the base resistor R1 have the connection as shown in FIG. 2, the voltage drop caused by the current $I_1$ flowing through the base resistor R1 is equal to the base-to-emitter voltage of the transistor Q4. Therefore, the current $I_1$ also has the same negative temperature coefficient of −2 mV/deg as that of the base-to-emitter voltage of the transistor Q4 on the supposition that the temperature coefficient of the resistor R1 is sufficiently small.

Since the current $I_1'$, which is equal to the current $I_1$, flows through the transistors Q8 and Q1 as the input current of the simple current mirror subcircuit formed by the transistors Q1 and Q2, the collector current $I_2$ of the transistor Q2 (i.e., the mirror current of this current mirror subcircuit) also has a negative temperature coefficient.

On the other hand, the collector current $I_3$ of the transistor Q3 (i.e., the mirror current of the Widlar current mirror subcircuit) has a positive temperature coefficient. This is because the Widlar current mirror subcircuit generates the mirror current $I_3$ while it converts the negative temperature coefficient of the input current $I_1'$ into a positive one.

Supposing that the base-to-emitter voltage of the transistor Q4 is 700 mV at room temperature and that it has a negative temperature coefficient of −2 mV/deg, the changing rate of the input current $I_1$ is expressed as $-2/700 \approx -2860$ ppm/deg. Therefore, the changing rate of the mirror current $I_3$ of the Widlar current mirror subcircuit due to the base-to-emitter voltage is expressed as $-2/700 \approx -2860$ ppm/deg.

On the other hand, the mirror current $I_3$ changes dependent upon the thermal voltage $V_T$. The changing rate of the mirror current $I_3$ due to the thermal voltage is expressed as $1/300 \approx -3333$ ppm/deg at room temperature (300 K).

As a result, the total changing rate of the mirror current $I_3$ is expressed as $-2860+3333=473$ ppm/deg.>0. This means that the mirror current $I_3$ of the Widlar current mirror subcircuit has a positive temperature coefficient.

The mirror current $I_2$ and the currents $I_1'$ and $I_1$ have the relationship of $I_2=K1 \cdot I_1'=K1 \cdot I_1$, and the mirror current $I_3$ and the currents $I_1'$ and $I_1$ have the relationship of $I_3=K2 \cdot I_1'=K2 \cdot I_1$. These two mirror currents $I_2$ and $I_3$ are added to be supplied to the transistor Q5, thereby outputting the reference current $I_{REF}$ through the simple current mirror subcircuit formed by the transistors Q5 and Q9.

Therefore, by suitably determining the constants K1 and K2, which represent the emitter area ratios (or, capacities) of the corresponding transistors Q2 and Q3 with respect to the transistor Q1, the negative temperature coefficient of the mirror current $I_2$ and the positive temperature coefficient of the mirror current $I_3$ can be canceled to be zero.

Here, the constants K1 and K2 are used for suitably weighting the respective mirror currents $I_2$ and $I_3$. In other words, The constants K1 and K2 are used for setting the adding ratio (K1/K2) of the currents $I_2$ and $I_3$.

The constant K3, which represents the emitter area ratio of the transistor Q5 with respect to the transistors Q9 and Q6, is determined so that the reference current $I_{REF}$ has a desired current value.

With the current reference circuit according to the first embodiment of FIG. 2, the simple current mirror subcircuit formed by the transistors Q1 and Q2 and the Widlar current mirror subcircuit formed by the transistors Q1 and Q3 and the resistor R2 are driven by the input current $I_1$ flowing through the resistor R1 and the transistor Q7, respectively. In other words, the bias or driver circuit for the simple and Widlar current mirror subcircuits includes the single bipolar transistor Q7 and the resistor R1 only between the power supply line of $V_{CC}$ and the ground.

Accordingly, the current reference circuit according to the first embodiment is able to be operated at a low supply voltage of approximately 1 V. This means that this current reference circuit can be operated by a single battery having a supply voltage of approximately 1.2 V.

Additionally, as stated above, the total changing rate of the mirror current $I_3$ of the Widlar current mirror subcircuit is 473 ppm/deg. If the emitter resistor R2 of the transistor Q3 has a changing rate of approximately −500 ppm/deg, the total changing rate of the mirror current $I_3$ will be approximately zero. This means that the simple current mirror subcircuit formed by the transistors Q1 and Q2 can be canceled by suitably setting the changing rate of the resistor R2.

SECOND EMBODIMENT

Figure 3:
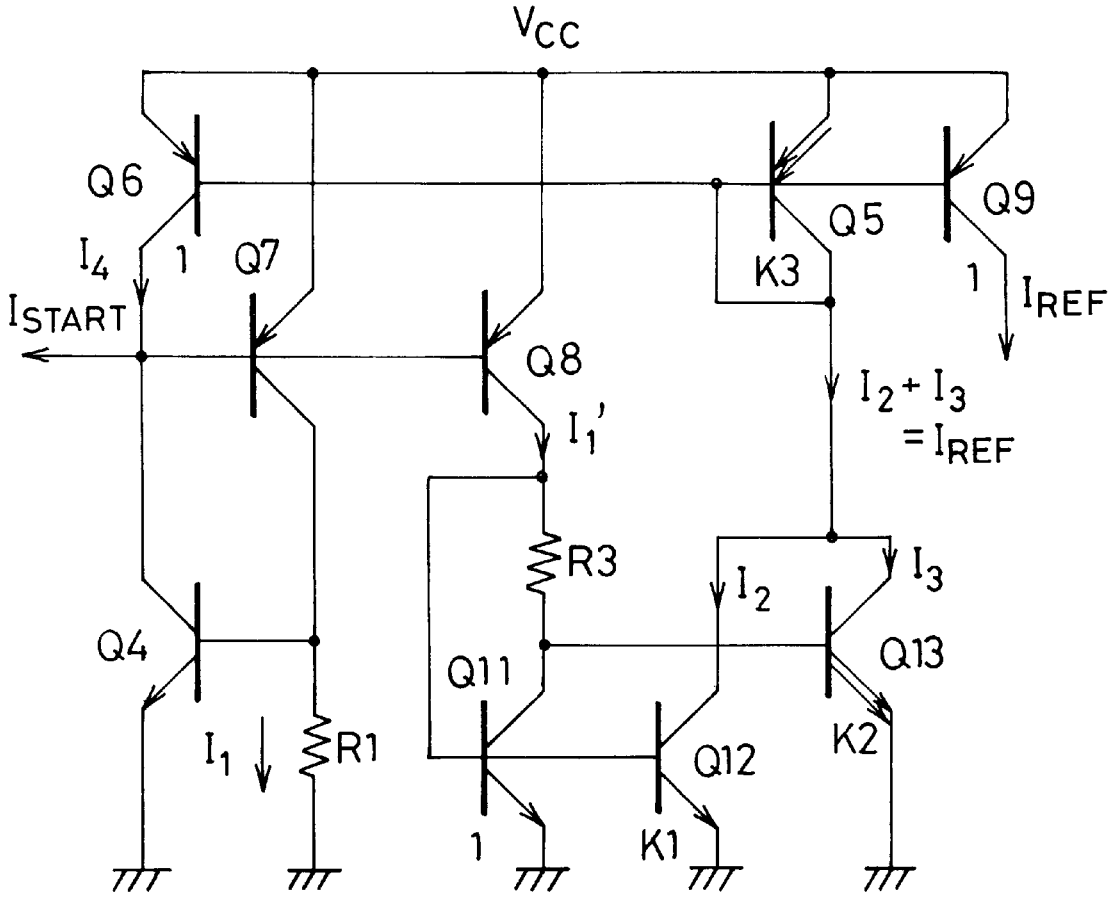
FIG. 3 is a circuit diagram of a bipolar current reference circuit according to a second embodiment of the present invention.

FIG. 3 shows a current reference circuit according to a second embodiment of the invention. This circuit has the same configuration as that of the first embodiment except that simple and Nagata current mirror subcircuits are provided instead of the combination of the simple and Widlar current mirror subcircuits in the first embodiment. Therefore, the description relating to the same configuration is omitted here by adding the same reference characters to the corresponding elements in this second embodiment for the sake of simplification.

In FIG. 3, an npn bipolar transistor Q11 has an emitter connected to the ground, and a base connected to the collector of the transistor Q8. The transistor Q11 has a collector connected to one end of a resistor R3. The other end of the resistor R3 is connected to the connection point of the base of the transistor Q11 and the collector of the transistor Q8. In other words, the collector of the transistor Q11 is connected to the base of the transistor Q11 through the resistor R3.

An npn bipolar transistor Q12 has an emitter connected to the ground, and a base connected to the base of the transistor Q11. The transistor Q12 has an emitter area K1 times as that of the transistor Q11, where K1 is a positive constant.

The two transistors Q11 and Q12 and the resistor R3 constitute a simple current mirror subcircuit. The collector current $I_1'$ of the transistor Q8 serves as an input current of this simple current mirror subcircuit. Therefore, this subcircuit generates a mirror current $I_2$ of the current $I_1'$ at a collector of the transistor Q12.

Since the transistor Q12 is K1 times in emitter area as the transistor Q11, the two currents $I_1'$ and $I_2$ have a relationship of $I_2=K1 \cdot I_1'(=K1 \cdot I_1)$.

An npn bipolar transistor Q13 has an emitter connected to the ground, and a base connected to the connection point of the collector of the transistor Q11 and the end of the resistor R3. The transistor Q13 has an emitter area K2 times as that of the transistor Q11, where K2 is a positive constant.

The two transistors Q11 and Q13 and the resistor R3 constitute a Nagata current mirror subcircuit. This subcircuit generates a mirror current $I_3$ of the input current $I_1'$ at the collector of the transistor Q13.

The subcircuit of the transistors Q11 and Q13 and the resistor R3 was called the "peaking current mirror" because of its peaking characteristic. However, recently, it has been usually called the "Nagata current mirror" based on the creator name.

Since the transistor Q3 is K2 times in emitter area as the transistor Q1, the two currents $I_1'$ and $I_3$ have a relationship of $I_3=K2\cdot I_1'(=K2\cdot I_1)$ .

Collectors of the transistors Q12 and Q13 are coupled together to be connected to the coupled base and collector of the diode-connected transistor Q5.

In the same manner as that of the first embodiment, the transistor Q4 is driven by the current $I_4$ whose current value is the same as that of the reference current $I_{REF}$, and a current loop extending along the bipolar transistors Q4, Q7, Q8, Q11, Q12, Q13, Q5 and Q6, and the resistors R1 and R3 is formed.

Next, the operation principle of the current reference circuit according to the second embodiment of FIG. 3 is explained below.

After a power switch (not shown) of this current reference circuit is turned on, the transistors Q7 and Q8 are driven by the same start-up current $I_{START}$ in the same manner as that shown in the first embodiment. The current $I_1'$ having the same current value as that of the current $I_1$ flows through the transistor Q8 and the resistor R3, thereby making the transistor Q11 to turn on. Thus, the simple current mirror subcircuit formed by the transistors Q11 and Q12 and the Nagata current mirror subcircuit formed by the transistors Q11 and Q13 start to be operated.

These two current mirror subcircuits generate their mirror currents $I_2$ and $I_3$ of the input current $I_1'$ at the collectors of the transistors Q12 and Q13, respectively. These two mirror currents $I_2$ and $I_3$ are added to one another at the coupled collectors of the transistors Q12 and Q13. The simple current mirror subcircuit formed by the transistors Q5 and Q9 generates the output reference current $I_{REF}$ as a mirror current of the input current $(I_2+I_3)$ at the collector of the transistor Q9, where $I_{REF}=(I_2+I_3)/K3$. At the same time, the simple current mirror subcircuit formed by the transistors Q5 and Q6 generates the mirror current $I_4$ of the input current $(I_2+I_3)$ at the collector of the transistor Q6, where $I_4=I_{REF}$. The current $I_4$ is supplied to the transistor Q4 which has been in the on-state. Thus, the above current loop is maintained during the operation.

Since the mirror current $I_4$ $(=I_{REF})$ flowing through the transistor Q4 has no temperature dependence, the base-to-emitter voltage of the transistor Q4 has a negative temperature coefficient of −2 mV/deg. The voltage drop caused by the current $I_1$ flowing through the base resistor R1 is equal to the base-to-emitter voltage of the transistor Q4. Therefore, the current $I_1$ also has the same negative temperature coefficient of −2 mV/deg as that of the base-to-emitter voltage of the transistor Q4 on the supposition that the temperature coefficient of the resistor R1 is sufficiently small.

Since the current $I_1'(=I_1)$ flows through the transistors Q8 and Q11 and the collector resistor R3 as the input current of the simple current mirror subcircuit formed by the transistors Q11 and Q12, the collector current $I_2$ of the transistor Q12 (i.e., the mirror current of this simple current mirror subcircuit) also has a negative temperature coefficient.

On the other hand, the Nagata current mirror subcircuit formed by the transistors Q11 and Q13 and the resistor R3 generates the mirror current $I_3$ while it converts the negative temperature coefficient of the input current $I_1'$ into a positive one. As a result, the collector current $I_3$ of the transistor Q13 as the mirror current of this Nagata current mirror subcircuit has a positive temperature coefficient.

In the same manner as that of the first embodiment, supposing that the base-to-emitter voltage of the transistor Q4 is 700 mV at room temperature and that it has a negative temperature coefficient of −2 mV/deg, the changing rate of the input current $I_1$ is expressed as −2/700≈−2860 ppm/deg. Therefore, the changing rate of the mirror current $I_3$ of the Nagata current mirror subcircuit due to the base-to-emitter voltage is expressed as −2/700≈−2860 ppm/deg.

On the other hand, the mirror current $I_3$ changes dependent upon the thermal voltage $V_T$. The changing rate of the mirror current $I_3$ due to the thermal voltage is expressed as 1/300≈−3333 ppm/deg at room temperature (300 K).

As a result, the total changing rate of the mirror current $I_3$ is expressed as −2860+3333=473 ppm/deg.>0. This means that the mirror current $I_3$ of the Nagata current mirror subcircuit has a positive temperature coefficient.

In the second embodiment also, the mirror current $I_2(=K1\cdot I_1'=K1\cdot I_1)$ and the mirror current $I_3(=K2\cdot I_1'=K2\cdot I_1)$ are added to be supplied to the transistor Q5, thereby generating the reference current $I_{REF}$ having no temperature dependence through the simple current mirror subcircuit formed by the transistors Q5 and Q9. Therefore, the constants K1 and K2, which represent the emitter area ratios of the corresponding transistors Q12 and Q13 with respect to the transistor Q11, are determined so that the negative temperature coefficient of the mirror current $I_2$ and the positive temperature coefficient of the mirror current $I_3$ are canceled to be zero. This is the same as that of the first embodiment.

With the current reference circuit according to the second embodiment of FIG. 3, the simple current mirror subcircuit including the transistors Q11 and Q12 and the Nagata current mirror subcircuit including the transistors Q11 and Q13 are driven by the current $I_1$ flowing through the resistor R1 and the transistor Q7, respectively. In other words, the bias or driving circuit for the simple and Nagata current mirror subcircuits includes the single bipolar transistor Q7 and the resistor R1 only between the power supply line held at the voltage $V_{CC}$ and the ground.

Accordingly, the current reference circuit according to the second embodiment also is able to be operated at a supply voltage of approximately 1 V.

THIRD EMBODIMENT

Figure 4:
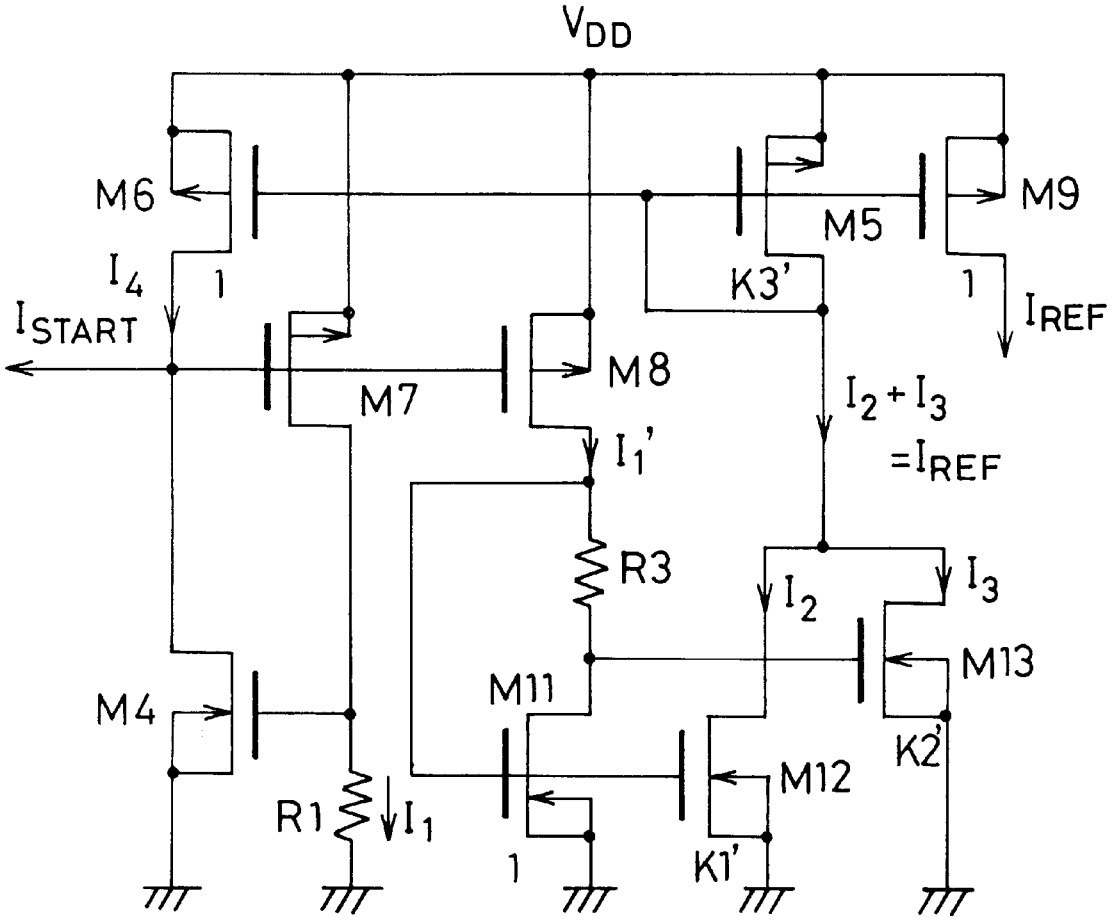
FIG. 4 is a circuit diagram of an MOS current reference circuit according to a third embodiment of the present invention.

FIG. 4 shows a current reference circuit according to a third embodiment of the invention. This circuit corresponds to one obtained by replacing the respective bipolar transistors in the second embodiment of FIG. 3 with MOSFETs.

As shown in FIG. 4, the current reference circuit according to the third embodiment comprises an n-channel MOSFET M4 having a source connected to the ground, and a gate connected to one end of a gate resistor R1. The other end of the resistor R1 is connected to the ground. The MOSFET M4 is biased by a voltage drop generated by an input current $I_1$ flowing through the resistor R1.

P-channel MOSFETs M7 and M8 have gates coupled together to be connected to a start-up circuit (not shown). The MOSFETs M7 and M8 are respectively driven by a start-up current $I_{START}$ supplied by the start-up circuit through their gates. A drain of the MOSFET M7 is connected to the connection point of the gate of the MOSFET M4 and the resistor R1. Sources of the MOSFETs M7 and M8 are connected to a power supply line (not shown) which is applied with a power supply voltage $V_{DD}$. The start-up circuit is further connected to a drain of the MOSFET M4 to supply the start-up current $I_{START}$ thereto.

An n-channel MOSFET M11 has a source connected to the ground. The MOSFET M11 has a gate and a drain coupled together through a resistor R3. The gate of the MOSFET M11 is connected to the drain of the MOSFET M8 and one end of the resistor R3. The drain of the MOSFET M11 is connected to the other end of the resistor R3.

An n-channel MOSFET M12 has a source connected to the ground and a gate connected to the gate of the MOSFET M11. The MOSFET M12 has a gate-width to gate-length ratio (W/L) K1' times as that of the MOSFET M11 where K1' is a positive constant. Here, since the gate-width to gate-length ratios (W/L) of the MOSFETs M12 and M11 are the same, K1'=1 is established.

The two MOSFETs M11 and M12 and the resistor R3 constitute a simple current mirror subcircuit. When a drain current of the MOSFET M8 is defined as $I_1'$, the current $I_1'$ serves as an input current of this simple current mirror subcircuit. Therefore, this subcircuit generates a mirror current $I_2$ of the current $I_1'$ at a drain of the MOSFET M12.

Since the MOSFET M12 is K1' times in gate-width to gate-length ratio (W/L) as the MOSFET M11, where K1'=1, the two currents $I_1'$ and $I_2$ have a relationship of $I_2=K1'\cdot I_1'=I_1'$.

An n-channel MOSFET M13 has a source connected to the ground and a gate connected to the gate of the MOSFET M11. A drain of the MOSFET M13 is connected to the drain of the MOSFET M12. The MOSFET M13 has a gate-width to gate-length ratio (W/L) K2' times as that of the MOSFET M11, where K2' is a positive constant. Here, K2' is greater than unity (i.e., K2'>1).

The two MOSFETs M11 and M13 and the resistor R3 constitute a Nagata current mirror subcircuit. This subcircuit generates a mirror current $I_3$ of the input current $I_1'$ at the drain of the MOSFET M13.

Since the MOSFET M3 is K2' times in gate-width to gate-length ratio (W/L) as the MOSFET M11, the two currents $I_1'$ and $I_3$ have a relationship of $I_3=K2'\cdot I_1'$, where K2'>1.

A p-channel MOSFET M5 has a gate and a drain coupled together. The coupled gate and the drain of the MOSFET M5 are connected to the coupled drains of the MOSFETs M12 and M13.

A p-channel MOSFET M9 has a gate connected to the gate of the MOSFET M5, and a source connected to the power supply line to be applied with the supply voltage $V_{DD}$. The MOSFET M5 has a gate-width to gate-length ratio (W/L) K3' times as much as that of the MOSFET M9, where K3' is a positive constant. Here, K3' is greater than unity (i.e., K3'>1).

A reference current $I_{REF}$ as an output of the current reference circuit according to the third embodiment is derived from a drain of the MOSFET M9.

The two MOSFETs M5 and M9 constitute a simple current mirror subcircuit. Because the drains of the MOSFETs M12 and M13 are connected in common to the drain of the MOSFET M5, a drain current of the MOSFET M5, which serves as an input current of this current mirror subcircuit, is expressed as the sum of the mirror currents $I_2$ and $I_3$, i.e., $(I_2+I_3)$. Since the MOSFET M5 is K3' times in gate-width to gate-length ratio (W/L) as the MOSFET M9, the reference current $I_{REF}$ is expressed as $I_{REF}=(I_2+I_3)/K3'$.

A p-channel MOSFET M6 has a gate connected to the gate of the MOSFET M5, and a source connected to the power supply terminal to be applied with the supply voltage $V_{DD}$. The MOSFET M6 has a drain connected to the drain of the MOSFET M4. The MOSFET 5 has a gate-width to gate-length ratio (W/L) K3' times as much as that of the MOSFET M6.

The two MOSFETs M5 and M6 constitute a simple current mirror subcircuit. The input current of this simple current mirror subcircuit is expressed as $(I_2+I_3)$, and the MOSFET M5 is K3' times in gate-width to gate-length ratio (W/L) as the MOSFET M6. Therefore, this current mirror subcircuit generates a mirror current $I_4$ which is equal to the reference current $I_{REF}$ at the drain of the MOSFET M6. Thus, the MOSFET M4 is driven by the reference current $I_{REF}$, and a current loop extending along the MOSFETs M4, QM, M8, M11, M12, M13, M5 and M6, and the resistors R1 and R3 is formed.

The operation principle of the current reference circuit according to the third embodiment of FIG. 4 is substantially the same as that of the second embodiment of FIG. 3.

Specifically, after a power switch (not shown) of this current reference circuit is turned on, the MOSFETs M7 and M8 are driven by the same start-up current $I_{START}$ in the same manner as that shown in the first embodiment. The current $I_1'$ having the same current value as that of the current $I_1$ flows through the MOSFET M8 and the resistor R3 to thereby make the MOSFET M11 turn on. Thus, the simple current mirror subcircuit formed by the MOSFETs M11 and M12 and the Nagata current mirror subcircuit formed by the MOSFETs M11 and M13 and the resistor R3 start to be operated.

These two current mirror subcircuits generate their mirror currents $I_2$ and $I_3$ of the input current $I_1'$ at the drains of the MOSFETs M12 and M13, respectively. These two mirror currents $I_2$ and $I_3$ are added to one another at the coupled drains of the MOSFETs M12 and M13. The simple current mirror subcircuit formed by the MOSFETs M5 and M9 generates the output reference current $I_{REF}$ as a mirror current of the input current $(I_2+I_3)$ at the drain of the MOSFET M9, where $I_{REF}=(I_2+I_3)/K3'$. At the same time, the simple current mirror subcircuit formed by the MOSFETs M5 and M6 generates the mirror current $I_4$ of the input current $(I_2+I_3)$ at the drain of the MOSFET M6, where $I_4=I_{REF}$. The current $I_4$ is supplied to the MOSFET M4 which have been in the on-state. Thus, the above current loop is maintained during the operation.

If the mirror current $I_2$ of the simple current mirror subcircuit formed by the MOSFETs M11 and M12 has a negative temperature coefficient, and the mirror current $I_3$ of the Nagata current mirror subcircuit formed by the MOSFETs M11 and M13 and the resistor R3 has a positive temperature coefficient, the temperature coefficient of the reference current $I_{REF}$ can be made zero by suitably determining the constants K1' and K2'.

Then, the fact that the mirror current $I_3$ has a positive temperature coefficient is explained below.

Supposing that each of the MOSFETs are matched in characteristic and ignoring the channel-length modulation and the body effect, a drain current of the MOSFET is typically expressed as the following equation $$I_D=\beta(V_{GS}-V_{TH})^2 \quad (1)$$

where $I_D$ is the drain current, $\beta$ is the transconductance parameter, $V_{GS}$ is the gate-to-source voltage, and $V_{TH}$ is the thermal voltage.

It is seen from the equation (1) that the drain current $I_D$ varies according to the square-law with respect to the gate-to-source voltage $V_{GS}$.

Here, β is defined as $$\beta = \mu\left(\frac{Cox}{2}\right)\left(\frac{W}{L}\right) \tag{2}$$

where $\mu$ is the effective mobility of a carrier, $C_{OX}$ is the gate-oxide capacitance per unit area, and W and L are the gate width and the gate length of each MOSFET, respectively.

The drain current of the MOSFET M11 is $I_1'$ and the drain current of the MOSFET M13 is $I_3$ and therefore, the following equation (3) is established as $$I_1' = K \cdot I_3 \tag{3}$$

where K is the mirror ratio of the Nagata current mirror subcircuit formed by the MOSFETs M11 and M13 and the resistor R3.

The gate-to-source voltages $V_{GS11}$ and $V_{GS13}$ of the MOSFETs M11 and M13 have the following relationship as $$V_{GS11} - V_{GS13} = R_3 \cdot I_1' \tag{4}$$

Therefore, from the above equations (1) to (4), the drain current $I_3$ of the MOSFET M13 is expressed by the following equation (5) as $$I_3 = K\beta R_3^2 I_1'\left(\sqrt{I_1'} - \frac{1}{R_3\sqrt{\beta}}\right)^2 \tag{5}$$

The effective mobility $\mu$ has a temperature dependence and the temperature characteristic of the transconductance parameter β is expressed as the following equation (6)

$$\beta = \beta_0\left(\frac{T}{T_0}\right)^{-\frac{3}{2}} \tag{6}$$

where $\beta_0$ is the value of β at room temperature (i.e., 300 K).

If the equation (6) is substituted into the equation (5) the following equation (7) is obtained.

$$I_3 = K\beta_0\left(\frac{T}{T_0}\right)^{-\frac{2}{3}} R_3^2 I_1'\left\{\sqrt{I_1'} - \frac{1}{R_3}\beta_0^{-\frac{1}{2}}\left(\frac{T}{T_0}\right)^{\frac{3}{4}}\right\}^2 \tag{7}$$

If the equation (7) is differentiated by absolute temperature T, the following equation (8) is obtained.

$$\frac{dI_3}{dT} = -\frac{3}{2}\frac{KR_1 I_1'}{T_0}\left\{\sqrt{I_1'} - \frac{1}{R_3}\beta_0^{-\frac{1}{2}}\left(\frac{T}{T_0}\right)^{\frac{3}{4}}\right\} \times \left[\beta_0 R3\left(\frac{T}{T_0}\right)^{-\frac{5}{2}}\left\{\sqrt{I_1'} - \frac{1}{R_3}\beta_0^{-\frac{1}{2}}\left(\frac{T}{T_0}\right)^{\frac{3}{4}} + \beta_0^{-\frac{1}{2}}\left(\frac{T}{T_0}\right)^{-\frac{7}{4}}\right\}\right] \tag{8}$$

In the equation (8), the following relationship (9) is established as $$\left\{\sqrt{I_1'} - \frac{1}{R_3}\beta_0^{-\frac{1}{2}}\left(\frac{T}{T_0}\right)^{\frac{3}{4}}\right\} < 0 \tag{9}$$

As a result, the following relationship (10) is established as $$\frac{dI_3}{dT} > 0 \tag{10}$$

The relationship (10) indicates that the drain current $I_3$ of the MOSFET M13 (i.e., the mirror current $I_3$ of the Nagata current mirror subcircuit) has a positive temperature coefficient. Further, it is seen from the equation (3) that the drain current $I_1'$ of the MOSFET M11 (i.e., the input current $I_1'$ of the simple and Nagata current mirror subcircuits) also has a positive temperature coefficient.

In the above calculation process, a supposition or approximation that the resistance $R_3$ of the resistor R3 has a negative temperature coefficient, i.e., $$\frac{dR_3}{dT} < 0 \tag{11}$$

is used.

On the other hand, the drain current $I_2$ of the MOSFET M12 (i.e., the mirror current $I_2$ of the simple current mirror subcircuit) has a negative temperature coefficient, which is the same as that of the second embodiment of FIG. 3.

Accordingly, by suitably determining the constants K1' and K2' (in other words, the mirror ratios of the simple and Nagata current mirror subcircuits), which represent the gate-width to gate-length ratios (W/L) of the corresponding MOSFETs M12 and M13 with respect to the MOSFET M11, the negative temperature coefficient of the mirror current $I_2$ and the positive temperature coefficient of the mirror current $I_3$ can be canceled to be zero.

With the current reference circuit according to the third embodiment of FIG. 4, the simple current mirror subcircuit formed by the MOSFETs M11 and M12 and the Nagata current mirror subcircuit formed by the MOSFETs M11 and M13 and the resistor R3 are driven by the same current $I_1$ flowing through the resistor R1 and the transistor Q7, respectively. In other words, the bias or driving circuit for the simple and Nagata current mirror subcircuits includes the single bipolar transistor Q7 and the resistor R1 only between the power supply line applied with the voltage $V_{DD}$ and the ground.

Accordingly, the current reference circuit according to the third embodiment also is able to be operated at a supply voltage of approximately 1 V.

FOURTH EMBODIMENT

Figure 5:
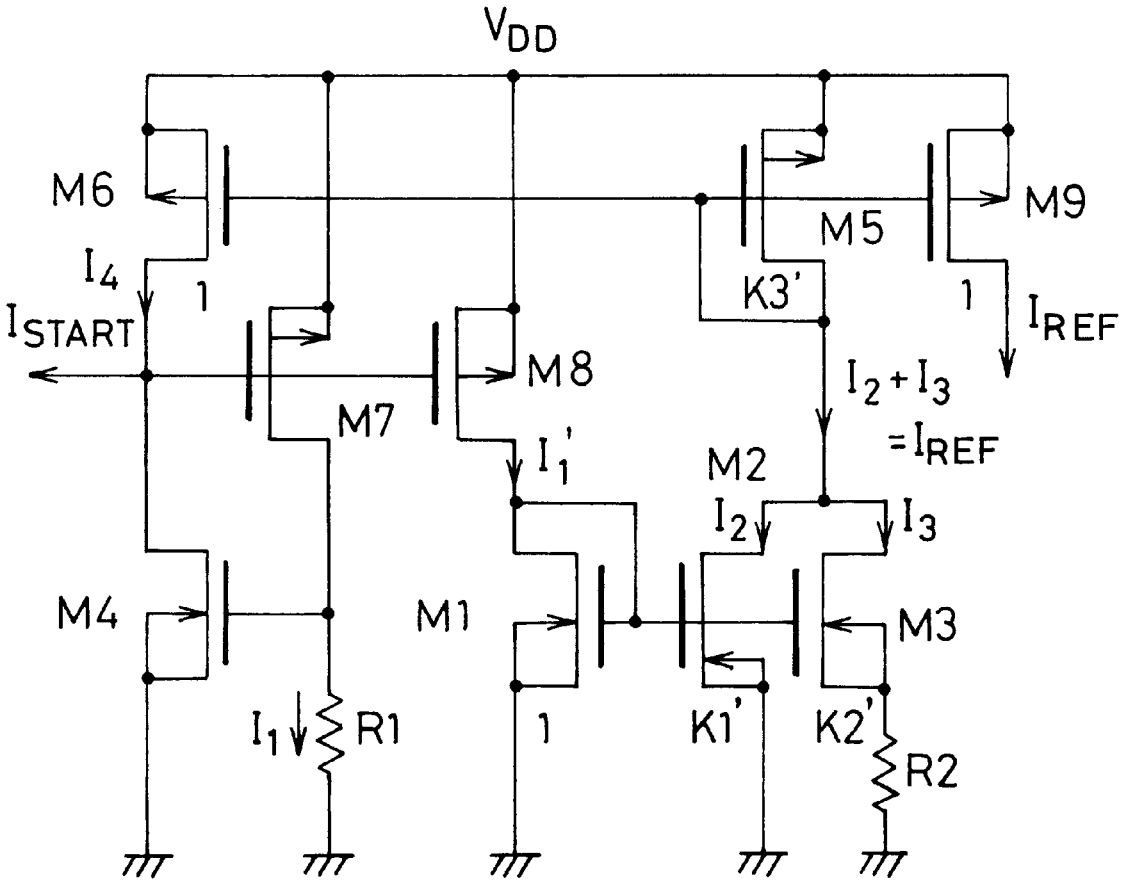
FIG. 5 is a circuit diagram of an MOS current reference circuit according to a fourth embodiment of the present invention.

FIG. 5 shows a current reference circuit according to a fourth embodiment of the invention. This circuit corresponds to one obtained by replacing the respective bipolar transistors in the first embodiment with MOSFETs. Further, this circuit has the same configuration as that of the third embodiment except that simple and Widlar current mirror subcircuits are used instead of the combination of the simple and Nagata current mirror subcircuits in the third embodiment.

Therefore, the description relating to the same configuration is omitted here by adding the same reference characters to the corresponding elements in this fourth embodiment for the sake of simplification.

As shown in FIG. 5, an n-channel MOSFET M1 has a source connected to the ground. The MOSFET M1 has a gate and a drain coupled together. The coupled gate and drain of the MOSFET M1 are connected to the drain of the MOSFET M8.

An n-channel MOSFET M2 has a source connected to the ground and a gate connected to the gate of the MOSFET M1. The MOSFET M2 has a gate-width to gate-length ratio (W/L) K1' times as that of the MOSFET M1 where K1' is a positive constant. Here, since the gate-width to gate-length ratios (W/L) of the MOSFETs M2 and M1 are the same, K1'=1 is established.

The two MOSFETs M1 and M2 constitute a simple current mirror subcircuit. The drain current $I_1'$ of the MOSFET M8 serves as an input current of this simple current mirror subcircuit. Therefore, this subcircuit generates a mirror current $I_2$ of the current $I_1'$ at a drain of the MOSFET M2.

Since the MOSFET M2 is K1' times in gate-width to gate-length ratio (W/L) as the MOSFET M1, where K1'=1, the two currents $I_1'$ and $I_2$ have a relationship of $I_2=K1'\cdot I_1'=I_1'$.

An n-channel MOSFET M3 has a source connected to one end of a source resistor R2 and a gate connected to the gate of the MOSFET M1. The other end of the resistor R2 is connected to the ground. A drain of the MOSFET M3 is connected to the drain of the MOSFET M2. The MOSFET M3 has a gate-width to gate-length ratio (W/L) K2' times as that of the MOSFET M1, where K2' is a positive constant. Here K2' is greater than unity (i.e., K2'>1).

The two MOSFETs M1 and M3 and the resistor R2 constitute a Widlar current mirror subcircuit. This subcircuit generates a mirror current $I_3$ of the input current $I_1'$ at the drain of the MOSFET M3.

Since the MOSFET M3 is K2 times in gate-width to gate-length ratio (W/L) as the MOSFET M1, the two currents $I_1'$ and $I_3$ have a relationship of $I_3=K2'\cdot I_1'$, where K2'>1.

Drains of the MOSFETs M2 and M3 are coupled together to be connected to the diode-connected MOSFET M5.

The MOSFET M4 can be driven by the reference current $I_{REF}$, and a current loop extending along the MOSFETs M4, M7, M8, M1, M2, M3, M5 and M6, and the resistors R1 and R2 is formed.

With the current reference circuit according to the fourth embodiment of FIG. 5, due to the same reason as described in the above third embodiment, the simple current mirror subcircuit formed by the MOSFETs M1 and M2 has a negative temperature coefficient, and the Widlar current mirror subcircuit formed by the MOSFETs M1 and M3 and the resistor R2 has a positive temperature coefficient.

Therefore, by suitably setting the constants K1' and K2', the temperature coefficient of the reference current $I_{REF}(=I_2+I_3)$ can be set as zero. As a result, the current reference circuit according to the fourth embodiment is also able to be operated at a supply voltage of approximately 1 V.

It is needless to say that the polarity of each bipolar transistor and each MOSFET may be opposite to that of the above first to fourth embodiments. Specifically, a pnp (or, npn) bipolar transistor may be used instead of an npn (or, pnp) bipolar transistor, and a p-channel (or, n-channel) MOSFET may be used instead of an n-channel (or, p-channel) MOSFET.

The driver subcircuit for the two current mirror subcircuits is not limited to the configuration as shown in the above first to fourth embodiments. Any other subcircuit may be used as the driver circuit if it is able to drive the two current mirror subcircuits by the input current $I_1$ without connecting any extra component or element to the resistor R1.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A current reference circuit comprising:

(a) a first transistor having an emitter or source and a base or gate, said emitter or source of said first transistor being connected to a first line kept at a first-level voltage;

(b) a resistor through which an input current flows, said base or gate of said first transistor being connected to a first end of said resistor, and a second end of said resistor being connected to said first line;

(c) a first current mirror subcircuit for generating a first current of said input current, said first mirror current having a negative temperature coefficient;

(d) a second current mirror subcircuit for generating a second mirror current of said input current, said second mirror current having a positive temperature coefficient;

(e) a driver subcircuit for driving said first and second current mirror subcircuits by said input current;

said first end of said resistor being connected to a second line kept at a second-level voltage through a circuit path within said driver subcircuit, wherein said input current flows through said circuit path; and said driver subcircuit connected to a collector or drain of the first transistor having an output connected to the inputs of said first and second current mirror subcircuits, respectively;

(f) a connection node for connecting an output of said first current mirror subcircuit and an output of said second current mirror subcircuit, whereby said first and second mirror currents are added thereby to generate a sum current having no temperature dependence;

(g) a third current mirror subcircuit connected to said connection node, said third current mirror subcircuit outputting an output current corresponding to said sum current as a reference current having no temperature dependence; and (h) a fourth current mirror subcircuit connected to said connection node, wherein said fourth current mirror subcircuit supplies a driving current corresponding to said sum current to said collector or drain of said first transistor for driving said first transistor.

2. A current reference circuit as claimed in claim 1, wherein said first current mirror subcircuit is a simple current mirror circuit, and said second current mirror subcircuit is a Widlar current mirror circuit.

3. A current reference circuit as claimed in claim 1, wherein said first current mirror subcircuit is a simple current mirror circuit, and said second current mirror subcircuit is a Nagata current mirror circuit.

4. A current reference circuit as claimed in claim 1, wherein said first current mirror subcircuit includes a second transistor and a third transistor, and said second current mirror subcircuit includes said second transistor and a fourth transistor;

and wherein said third transistor has a capacity K1 times as much as that of said second transistor, where K1 is a positive constant, and said fourth transistor has a capacity K2 times as much as that of said second transistor, where K2 is a positive constant;

and wherein an adding ratio of said first and second mirror currents is determined by a ratio of said constants K1 and K2 to remove the temperature dependence of said sum current.

5. A current reference circuit as claimed in claim 1, said driving circuit having second and third transistors driven by a start-up current;

wherein said second transistor is connected to said resistor so that said input current flows through said second transistor;

and wherein said third transistor supplies said input current to said first current mirror subcircuit, thereby generating said first mirror current.

6. A current reference circuit comprising:

(a) a first bipolar transistor having an emitter, a base, and a collector, said emitter being connected to a first line kept at a first-level voltage;

(b) a resistor having a first end connected to said first line and a second end connected to said base of said first bipolar transistor;

(c) a first current mirror subcircuit generating a first mirror current having a negative temperature coefficient;

(d) a second current mirror subcircuit for generating a second mirror current having a positive temperature coefficient;

(e) a driver subcircuit for driving said first and second current mirror subcircuits, respectively;

said driver subcircuit connected to a collector of the first transistor including second and third bipolar transistors initially driven by a start-up current;

said second bipolar transistor being connected to said second end of said resistor and a second line kept at a second-level voltage; and said third bipolar transistor being connected to inputs of said first and second current mirror subcircuits and to said second line;

(f) a connection node for connecting an output of said first current mirror subcircuit and an output of said second current mirror subcircuit, whereby said first and second mirror currents are added thereby to generate a sum current having no temperature dependence;

(g) a third current mirror subcircuit connected to said connection node, said third current mirror subcircuit outputting an output current corresponding to said sum current as a reference current having no temperature dependence; and (h) a fourth current mirror subcircuit connected to said connection node, wherein said fourth current mirror subcircuit supplies a driving current corresponding to said sum current to said collector of said first transistor thereby driving said first transistor.

7. A current reference circuit as claimed in claim 6, wherein said first current mirror subcircuit is a simple current mirror circuit, and said second current mirror subcircuit is a Widlar current mirror circuit.

8. A current reference circuit as claimed in claim 6, wherein said first current mirror subcircuit is a simple current mirror circuit, and said second current mirror subcircuit is a Nagata current mirror circuit.

9. A current reference circuit as claimed in claim 6 wherein said first current mirror subcircuit includes a fourth bipolar transistor and a fifth bipolar transistor, and said second current mirror subcircuit includes said fourth bipolar transistor and a sixth bipolar transistor;

and wherein said fifth transistor has an emitter area K1 times as much as that of said fourth transistor, where K1 is a positive constant, and said sixth transistor has an emitter area K2 times as much as that of said fourth transistor, where K2 is a positive constant;

and wherein an adding ratio of said first and second mirror currents is determined by a ratio of said constants K1 and K2 to remove the temperature dependence of said sum current.

10. A current reference circuit comprising:

(a) a first MOSFET having a source, a gate, and a drain, said source being connected to a first line kept at a first-level voltage;

(b) a resistor having a first end connected to said first line and a second end connected to said gate of said first MOSFET;

(c) a first current mirror subcircuit generating a first mirror current having a negative temperature coefficient;

(d) a second current mirror subcircuit for generating a second mirror current having a positive temperature coefficient;

(e) a driver subcircuit for driving said first and second current mirror subcircuits, respectively;

said driver subcircuit connected to said drain of the first MOSFET including second and third MOSFETs initially driven by a start-up current;

said second MOSFET being connected to said second end of said resistor and a second line kept at a second-level voltage; and said third MOSFET being connected to inputs of said first and second current mirror subcircuits and to said second line;

(f) a connection node for connecting an output of said first current mirror subcircuit and an output of said second current mirror subcircuit, whereby said first and second mirror currents are added thereby to generate a sum current having no temperature dependence;

(g) a third current mirror subcircuit connected to said connection node, said third current mirror subcircuit outputting an output current corresponding to said sum current as a reference current having no temperature dependence; and (h) a fourth current mirror subcircuit connected to said connection node, wherein said fourth current mirror subcircuit supplies a driving current corresponding to said sum current to said drain of said first MOSFET thereby driving said first MOSFET.

11. A current reference circuit as claimed in claim 10, wherein said first current mirror subcircuit is a simple current mirror circuit, and said second current mirror subcircuit is a Widlar current mirror circuit.

12. A current reference circuit as claimed in claim 10, wherein said first current mirror subcircuit is a simple current mirror circuit, and said second current mirror subcircuit is a Nagata current mirror circuit.

13. A current reference circuit as claimed in claim 10, wherein said first current mirror subcircuit includes a fourth MOSFET and a fifth MOSFET, and said second current mirror subcircuit includes said fourth MOSFET and a sixth MOSFET;

and wherein said fifth MOSFET has a gate-width to gate-length ratio K1 times as much as that of said fourth MOSFET, where K1 is a positive constant, and said sixth MOSFET has a gate-width to gate-length ratio K2 times as much as that of said fourth MOSFET, where K2 is a positive constant;

and wherein an adding ratio of said first and second mirror currents is determined by a ratio of said constants K1 and K2 to remove the temperature dependence of said sum current.

14. A current reference circuit comprising:

(a) an input current generator subcircuit for generating an input current;

(b) a first current mirror subcircuit for generating a first mirror current of said input current, said first mirror current having a negative temperature coefficient;

(c) a second current mirror subcircuit for generating a second mirror current of said input current, said second mirror current having a positive temperature coefficient;

(d) a driver subcircuit for driving said first and second current mirror subcircuits by said input current;

(e) a connection means for connecting the outputs of said first and second current mirror circuits, whereby said first and second mirror currents being added thereby to generate a sum current having no temperature dependence; and (f) providing said sum current as a reference current having no temperature dependence;

characterized in that said input current generator subcircuit includes:

(g) a first transistor having an emitter or source and a base or gate, said emitter or source of said first transistor being connected to a first line kept at a first-level voltage;

(h) a resistor through which an input current flows, said base or gate of said first transistor being connected to a first end of said resistor, and a second end of said resistor being connected to said first line;

(i) said first end of said resistor being connected to a second line kept at a second-level voltage through a current path within said driver circuit;

(j) a current equal to said sum current being supplied by said connection means to a collector or drain of said first transistor for driving said first transistor;

(k) said driver subcircuit connected to the connection point of said resistor and said base or gate of said first transistor; and (l) said driver subcircuit having an output connected to the inputs of said first and second current mirror subcircuits, respectively.

15. A current reference circuit comprising:

(a) a first transistor having an emitter or source and a base or gate, said emitter or source of said first transistor being connected to a first line kept at a first-level voltage;

(b) a resistor through which an input current flows, said base or gate of said first transistor being connected to a first end of said resistor, and a second end of said resistor being connected to said first line;

(c) a first current mirror subcircuit for generating a first mirror current of said input current, said first mirror current having a negative temperature coefficient;

(d) a second current mirror subcircuit for generating a second mirror current of said input current, said second mirror current having a positive temperature coefficient;

(e) a driver subcircuit connected to a collector or drain of the first transistor for driving said first and second current mirror subcircuits by said input current;

said first end of said resistor being connected to a second line kept at a second-level voltage through a circuit path within said driver subcircuit, wherein said input current flows through said circuit path; and said driver subcircuit having an output connected to the inputs of said first and second current mirror subcircuits, respectively;

(f) a means for adding said first and second mirror currents to generate a sum current having no temperature dependence; and (h) a means for supplying a current corresponding to said sum current to said collector or drain of said first transistor for driving said first transistor and for providing said sum current as a reference current having no temperature dependence.

16. A current reference circuit comprising:

(a) a first bipolar transistor having an emitter, a base, and a collector, said emitter being connected to a first line kept at a first-level voltage;

(b) a resistor having a first end connected to said first line and a second end connected to said base of said first bipolar transistor;

(c) a first current mirror subcircuit generating a first mirror current having a negative temperature coefficient;

(d) a second current mirror subcircuit for generating a second mirror current having a positive temperature coefficient;

(e) a driver subcircuit connected to said collector of the first transistor for driving said first and second current mirror subcircuits, respectively;

said driver subcircuit including second and third bipolar transistors initially driven by a start-up current;

said second bipolar transistor being connected to said second end of said resistor and a second line kept at a second-level voltage; and said third bipolar transistor being connected to inputs of said first and second current mirror subcircuits and to said second line;

(f) means for adding said first and second mirror currents are added to generate a sum current having no temperature dependence; and (g) means for supplying a current corresponding to said sum current to said collector of said first transistor thereby driving said first transistor and for providing said sum current as a reference current having no temperature dependence.

17. A current reference circuit comprising:

(a) a first MOSFET having a source, a gate, and a drain, said source being connected to a first line kept at a first-level voltage;

(b) a resistor having a first end connected to said first line and a second end connected to said gate of said first MOSFET;

(c) a first current mirror subcircuit generating a first mirror current having a negative temperature coefficient;

(d) a second current mirror subcircuit for generating a second mirror current having a positive temperature coefficient;

(e) a driver subcircuit connected to a source of the first MOSFET for driving said first and second current mirror subcircuits, respectively;

said driver subcircuit including second and third MOSFETs driven initially by a start-up current;

said second MOSFET being connected to said second end of said resistor and a second line kept at a second-level voltage; and said third MOSFET being connected to inputs of said first and second current mirror subcircuits and to said second line;

(f) means for adding said first and second mirror currents to generate a sum current having no temperature dependence; and (g) means for supplying a current corresponding to said sum current to said drain of said first MOSFET thereby driving said first MOSFET providing said sum current as a reference current having no temperature dependence.

18. A current reference circuit comprising:

(a) an input current generator subcircuit for generating an input current;

(b) a first current mirror subcircuit for generating a first mirror current of said input current, said first mirror current having a negative temperature coefficient;

(c) a second current mirror subcircuit for generating a second current of said input current, said second mirror current having a positive temperature coefficient;

(d) a driver subcircuit for driving said first and second current mirror subcircuits by said input current;

(e) means for adding said first and second mirror currents to generate a sum current having no temperature dependence and for providing sum current as a reference current having no temperature dependence;

characterized in that said input current generator subcircuit includes:

(f) a first transistor having an emitter or source and a base or gate, said emitter or source of said first transistor being connected to a first line kept at a first-level voltage;

(g) a resistor through which an input current flows, said base or gate of said first transistor being connected to a first end of said resistor, and a second end of said resistor being connected to said first line;

(h) said first end of said resistor being connected to a second line kept at a second-level voltage through said driver circuit;

(i) a current equal to said sum current being supplied by said connection means to a collector or drain of said first transistor for driving said first transistor;

(j) said driver subcircuit connected to the connection point of said resistor and said base or gate of said first transistor; and (k) said driver subcircuit having an output connected to the inputs of said first and second current mirror subcircuits, respectively.

* * * * *